United States Patent [19]

Willis

[11] 4,032,034

[45] June 28, 1977

[54] PRESSURE RELEASE DEVICE FOR A CONTAINER

[75] Inventor: Wilburn Coy Willis, Hagerstown, Ind.

[73] Assignee: Aluminum Company of America, Pittsburgh, Pa.

[22] Filed: Nov. 18, 1976

[21] Appl. No.: 742,893

[52] U.S. Cl. ..... 220/266; 220/268; 220/271; 220/367

[51] Int. Cl.² ..... B65D 41/32

[58] Field of Search ..... 220/266–273, 220/367

[56] References Cited

UNITED STATES PATENTS

| | | | |
|---|---|---|---|
| 3,262,611 | 7/1966 | Palmer | 220/268 |
| 3,416,698 | 12/1968 | Arfert | 220/271 |
| 3,720,348 | 3/1973 | Jakobsen | 220/271 |
| 3,779,417 | 12/1973 | Klein | 220/268 |
| 3,794,206 | 2/1974 | DeLine et al. | 220/268 |

*Primary Examiner*—George T. Hall
*Attorney, Agent, or Firm*—David W. Brownlee

[57] ABSTRACT

A container wall is disclosed having vent means in it for forming an opening in the container wall by digital force to release the pressure in a container which includes such wall. The force required to actuate the pressure release is not significantly affected by the internal pressure in the container due to the particular construction of the container wall as including two outwardly projecting hollow embossments separated by an inwardly projecting hollow rib with a score line across the rib near its middle. Each embossment has a top wall and a side wall therearound connecting the top wall to the adjacent portion of the container wall and with the side wall at both ends of the rib being generally transverse to the longitudinal axis of the rib. The apex of the rib is generally coplanar with the general plane of the container wall adjacent to the embossment and the side wall of each embossment is preferably thinner than the material in the adjacent container wall.

11 Claims, 13 Drawing Figures

FIG. 6.
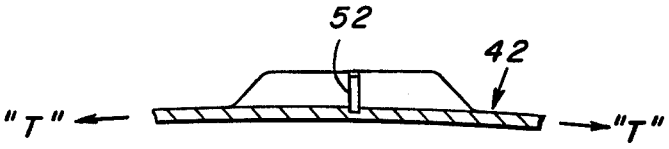
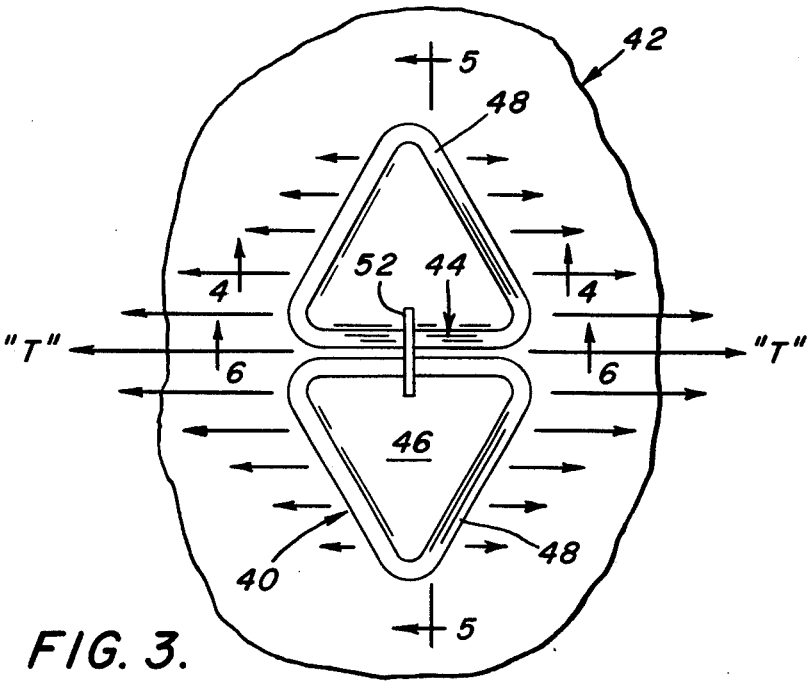
FIG. 3.
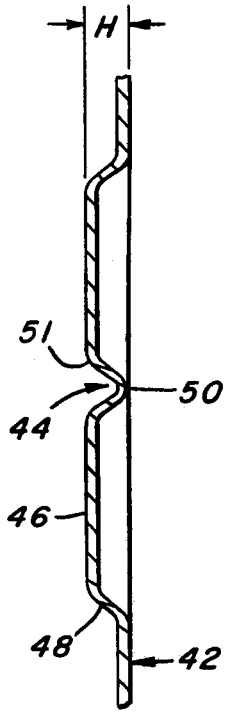
FIG. 5.
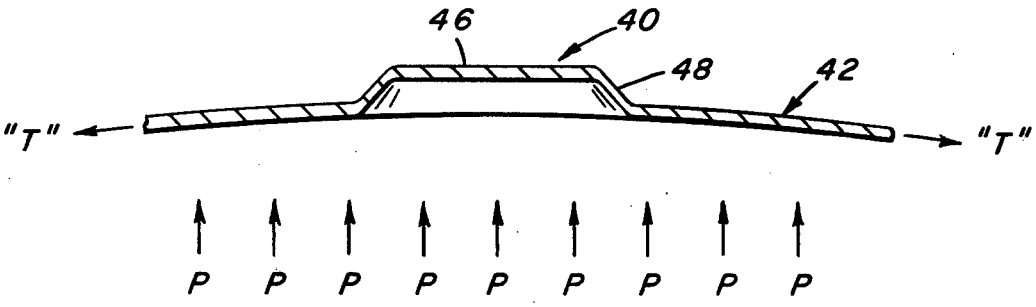
FIG. 4.

PRESSURE RELEASE DEVICE FOR A CONTAINER

BACKGROUND OF THE INVENTION

1. Field of Art

This invention relates to pressurized containers and in particular to means for forming a vent opening in the wall of a pressurized container to release the pressure therein.

2. Brief Description of the Prior Art

It is known to form an embossed rib in a container wall with a transverse score line across the rib to facilitate rupture of the container wall as is disclosed in an application for United States Letters Patent Ser. No. 684,836, filed May 10, 1976 for "Container Wall with Rupturable Weakening Line". The combination of an embossed hollow rib and a transverse score line acts in a manner similar to a notched beam. In a container wall having an embossed rib therein with a score line across the rib, the score line can be easily ruptured by applying force against the rib at the score line on the side of the container wall opposite that from which the rib projects. The score line weakens the side of the rib which is in tension under such loading so the rib and score line can be easily broken. Conversely, pressure applied against the container wall on the side thereof from which the rib projects does not easily rupture the score line because such loading places the residual metal in the score line in compression rather than tension. An embossed rib and transverse score line may be employed in a container wall either to facilitate rupture of the wall by digitally applied force or by excessive pressure in a container.

In recent years, the widespread use of metal easy-opening cans having severable tear strips has created a litter problem due to the propensity of consumers to indiscriminately dispose of the severed tabs. Consequently, considerable time and money have been expended to develop easy-opening can ends having non-severable tear tabs and tear strips. As a result, a number of easy-opening ends have been developed which have inwardly displaceable tabs as for example are disclosed in U.S. Pat. Nos. 3,362,569; 3,881,630; 3,886,881 and 3,929,251, among others. However, the force required to open push-in tabs in can ends has heretofore been affected by the internal pressure in the cans. To minimize the effect of the internal pressure, a smaller opening tab has been provided in some can ends to initially vent the internal pressure as is disclosed in U.S. Pat. No. 3,741,432. However, even a small tab in a can end is affected by the pressure and can be difficult to open.

A digitally operable pressure release device is desired for easy-opening can ends and other containers which will not be affected by the internal pressure in the container.

SUMMARY OF THE INVENTION

This invention provides a container wall having means therein for forming an opening in the wall to vent pressures from a container in which the force required to actuate such vent release is not significantly affected by the pressure in the container. In accordance with the invention, the vent release comprises two outwardly projecting hollow embossments in the container wall separated by and forming therebetween an inwardly projecting hollow rib with a score line across the rib near the middle of the rib with each of the embossments having a top wall and a side wall which includes portions at both ends of the rib which are generally transverse to the longitudinal axis of the rib. The side wall of the embossment connects the top wall to the adjacent portion of the container wall and is preferably thinner than the material in the adjacent container wall.

Accordingly, an object of this invention is to provide means in a container wall which is adapted to form a vent release in the container wall in response to digital pressure applied against the container wall and which is not adversely affected by variations in the pressure in the container.

The above and other objects and advantages of this invention will be more fully understood and appreciated with reference to the following description and the drawings attached hereto.

BRIEF DESCRIPTION OF THE DRAWINGS

FIG. 3 is a fragmentary plan view of an alternative embodiment of a container wall of this invention.

FIGS. 4, 5 and 6 are cross sections through the container wall of FIG. 3.

DESCRIPTION OF PREFERRED EMBODIMENTS

Figure 1:
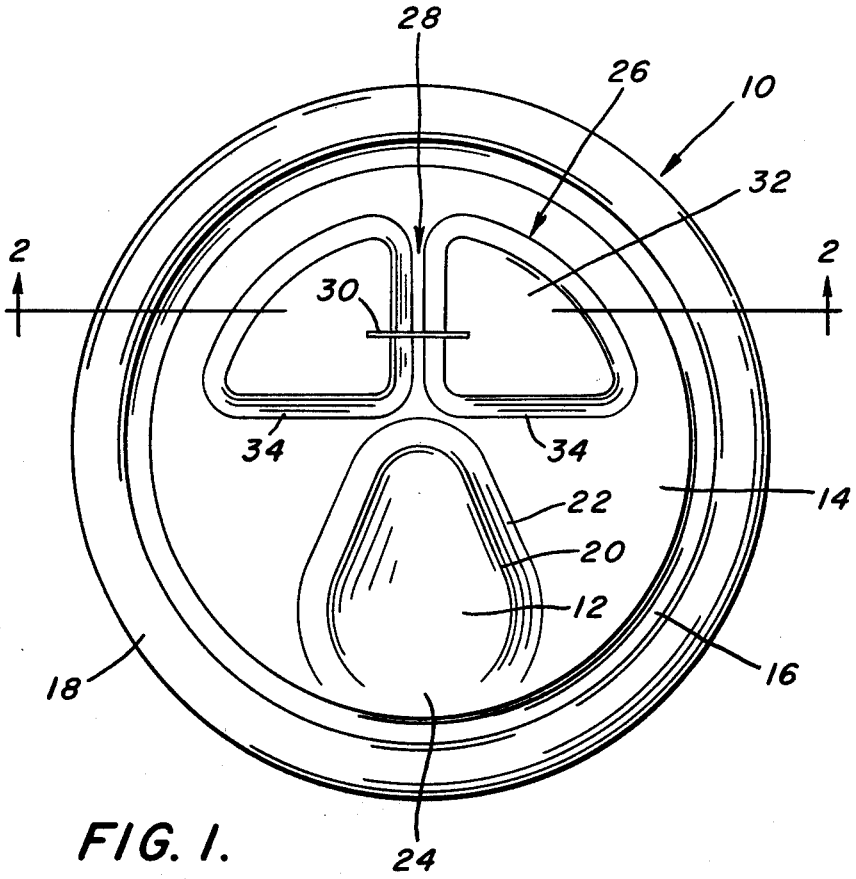
FIG. 1 is a plan view of a container wall of this invention showing the exterior surface of the can end when sealed on a can body.
Figure 2:
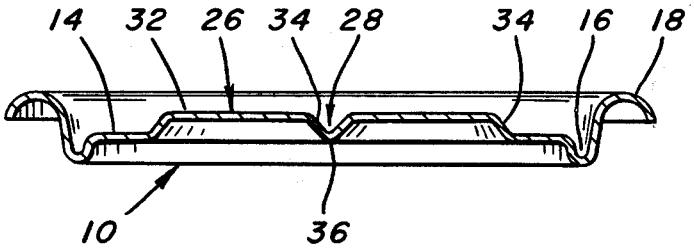
FIG. 2 is a cross section through the container wall of FIG. 1 taken along line 2—2 of that figure.

FIGS. 1 and 2 illustrate an easy-opening can end 10 having an inwardly displaceable tab 12 of the type which is disclosed and claimed in U.S. Pat. No. 3,982,657, and also having a vent release device formed in accordance with this invention. The can end 10 has a central panel portion 14 in which the depressible tab 12 and vent release device are formed, a peripheral groove 16 around the central panel and a peripheral flange 18 for double seaming the can end on a can in a conventional manner. As used herein, the terms "inwardly" and "outwardly" mean the directions relative to the interior and exterior respectively of a can or other container with a container wall of this invention sealed thereon.

The depressible tab 12 is defined by a frangible web 20 with a raised deflectable portion 22 therearound to facilitate initiation of fracture of the frangible web. The frangible web 20 is preferably continuous around the depressible tab except for a hinge portion 24 adjacent the reinforcing groove 16. The depressible tab 12 is adapted to be opened by first applying digital pressure against the raised deflectable portion 22 at the frangible web to produce high localized stresses in the frangible web to initiate fracture thereof. The deflectable portion 22 may be pressed at two or more locations to initiate fracture of the web substantially entirely around the depressible tab. After the frangible web has been fractured around most or all of the depressible tab, the tab can be depressed into a can by the application of digital pressure directly against the tab. Depressing the tab 12 into a can produces an opening therein for both emptying the contents of the can and permitting the ingress of air into the can as the contents are being emptied therefrom.

In easy-opening can ends having inwardly displaceable tabs, the internal pressure in a can resists the digital force applied against the can ends to open them. When the pressure in a can is relatively high, such as approximately 60 to 90 pounds per square inch, the increased digital force required to open the can end can be substantial and make opening difficult.

In accordance with this invention, a pressure release device is provided in a can end or a container wall for easily venting the pressure in a container regardless of the magnitude of the pressure. As illustrated in FIGS. 1 and 2, the pressure release device is provided in the form of two adjacent outwardly projecting hollow embossments 26 in the central panel 14 of the can end 10 separated by and forming therebetween an inwardly projecting hollow rib 28 with a score line 30 across the rib. Each embossment 26 has a top wall 32 and a side wall 34 therearound disposed at an angle to the panel 14 and connecting the embossment thereto. The side wall 34 of each embossment 26 circumscribes the embossment and, at the ends of the rib 28, is generally transverse to the longitudinal axis of the rib. The rib 28 is formed by the side walls 34 of the embossments 26 and has a rounded apex 36 between the embossments which is generally coplanar with the general plane of the panel 14 in the can end.

The score line 30 across the rib 28 is adapted to be ruptured by force applied digitally against the exterior surface of the can end approximately at the intersection of the rib 28 and the score line. Rupture of the score line 30 permits pressurized gases in a container to escape through the opening which is thereby formed to equalize the pressures on the inside and outside of the can. Once the pressures are equalized, the depressible tab 12 may be more easily opened by pressing on the deflectable portion 22 therearound to initiate fracture of the frangible web 20. As will be explained with reference to FIGS. 3–6, the construction of the embossments 26, rib 28 and score line 30 of this invention make the pressure release device substantially immune to changes in opening force due to differentials in pressure in a container on which the can end is sealed.

FIGS. 3–6 illustrate an alternative embodiment of a pressure release device of this invention comprising two adjacent triangular-shaped, hollow embossments 40 in a container wall 42 forming a hollow rib 44 therebetween. For use in a container wall on a pressurized container, the wall 42 illustrated in FIGS. 3–6 is oriented with the embossments 40 projecting outwardly from the container so the surface viewed in FIG. 3 is the exterior surface of the container wall. As so oriented, the embossments include a top wall 46 and a side wall 48 around the embossments connecting the top wall 46 with the adjacent portions of the container wall 42. The side walls 48 of the embossments 40 form a hollow rib 44 between the embossments projecting inwardly of the container, with a rounded apex 50 on the rib between the embossments generally coplanar with the wall 42. A score line 52 crosses the rib approximately at its midpoint as is illustrated in FIG. 3. (The width of the score line 52 is exaggerated in FIGS. 3 and 6 for clarity.) In a preferred embodiment of this invention, the material of the side wall 48 of each embossment 40 is thinner than the material of the remainder of the container wall 42. The side wall 48 of the embossment is thinned during forming to facilitate raising the embossment as will be described. The thin side wall 48 also helps to provide the desired distribution of stresses in the rib 44 as will also be described.

To rupture the score 52 in container wall 42, force is applied against the exterior surface of the wall where the score crosses the rib 44 to stress the residual metal in the score in tension and cause it to fail. Force applied against the rib on the exterior surface of the container wall at the score line 52 places the apex 50 of the rib in tension and the junction 51 of the rib and the top wall 46 of each embossment in compression. The score line 52 does not significantly weaken the metal which is in compression, but does substantially weaken the metal against the tensional stresses at the apex of the rib. Thus, digital force applied against the exterior surface of the container wall will easily rupture the score line across the apex of the rib. Conversely, however, force applied against the interior surface of the metal will not rupture the score line because the metal in the apex of the rib is then in compression rather than tension. The metal in the score line at the junction 51 of the rib and the top wall is not easily ruptured under such internal pressure because there is a large metal section in the top wall 46 of the embossment which resists bending the rib.

Following is an explanation of why it is believed a pressure release device of this invention is not significantly affected by changes in the internal pressure in a container.

The pressure P in a container acting on the pressure release device presses against the interior surface of the container wall and supports the wall from being pressed inwardly. As illustrated in FIG. 4, the pressure P causes the container wall to dome outwardly slightly, which results in a bending moment being applied to the hollow rib 44. This bending moment, acting on the substantially rigid rib 44, introduces compression stresses at apex 50 of the hollow rib, which stresses resist rupture of the score line 52. However, the compression stresses at apex 50 are offset by the tension stresses T in the somewhat flexible end wall 42, as shown in FIGS. 3, 4 and 6. Any can end that is subject to internal pressure is stretched somewhat by the consequent doming, and this stretching gives rise to radially directed tension stresses. However the particular tension stresses T that offset the compression stresses acting on the rib 44 of the present invention are the product of the effect of internal pressure P on the side walls 48 of the embossment. Since the side wall 48 of each embossment is substantially transverse to the longitudinal axis of the rib 44 at the ends of the rib, pressure against such side wall places the score line 52 in the rib in tension. The net result of the compression stresses and the tension stresses at the intersection of score line 52 and hollow rib 44 at apex 50 is substantially zero. This neutralizing effect is maintained at internal pressures P of from 0 to 90 psi.

The height H of the side wall 48 of each embossment 40, as viewed in FIG. 5, is selected to provide the magnitude of the tension stresses T which will effectively cancel out the compression stresses caused by the pressure against the rib. A preferred embodiment of the invention includes a side wall height H of at least five, and preferably approximately seven, times the thickness of the container wall. A height H is selected which will produce tension stresses T which are approximately equal to the increase in compression stresses produced in the rib by internal pressure in a container. Thus, the embossments 40 which form the rib 44 substantially negate any change in the force required to initiate rupture of the score line 52.

In an exemplary container wall, the wall is made of hard temper aluminum alloy sheet material having a nominal gauge of 0.013 inch and has two raised triangular-shaped embossments thereon having a height or projection of approximately 0.10 inch outwardly from the wall with a rib of approximately the same projection inwardly between the embossments. The side wall of each embossment is disposed at approximately a 45° angle to the general plane of the adjacent portions of the container wall and is thinned to approximately three-fourths the original thickness of the metal. The rib has a length of approximately five eighths inch. A score line across the rib has a residual metal thickness of approximately 0.005 inch, crosses the rib at approximately its mid-point, and extends approximately one eighth inch into the top wall of the embossments on both sides of the rib. The force required to vent container walls having such construction is approximately 20 pounds for containers having internal pressures ranging from zero to 90 psi.

Figure 7:
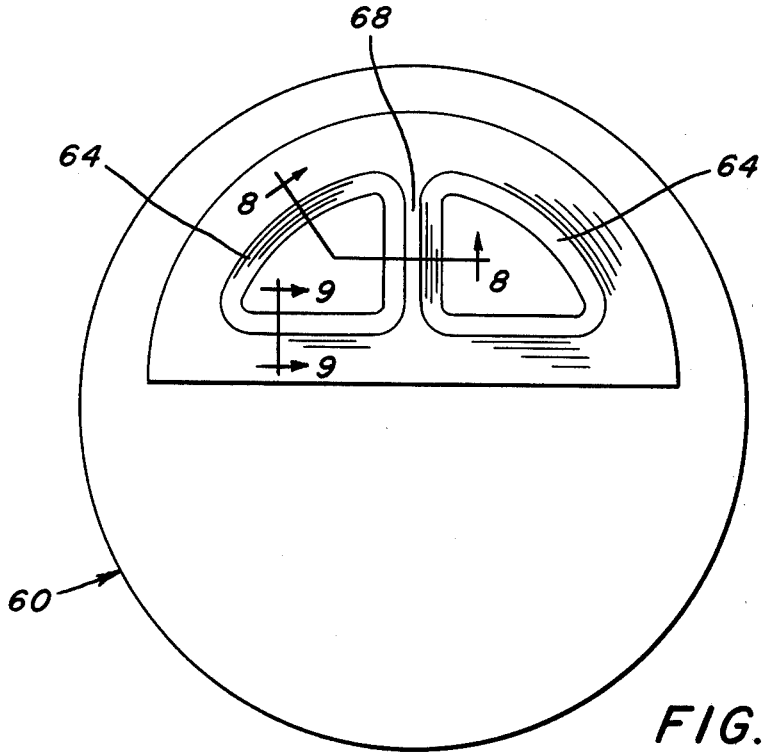
FIG. 7 is a plan view of a coining punch for forming the vent release device in the container wall of FIG. 1.
Figure 8:
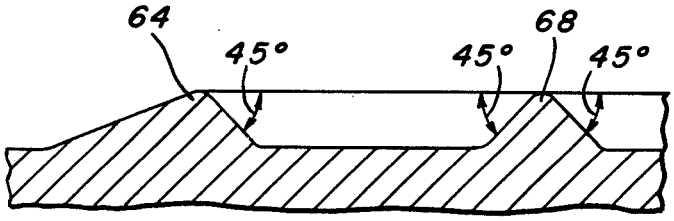
FIG. 8 is a cross-sectional view through the center rib of the coining punch illustrated in FIG. 7.
Figure 9:
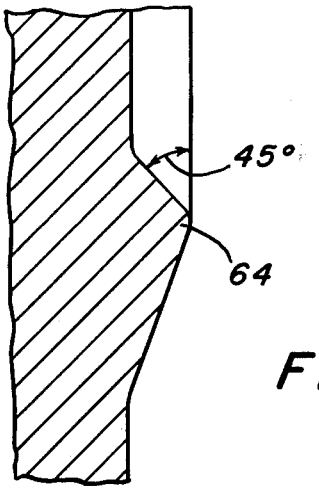
FIG. 9 is a cross-sectional view through the peripheral rib in the coining punch of FIG. 7.
Figure 10:
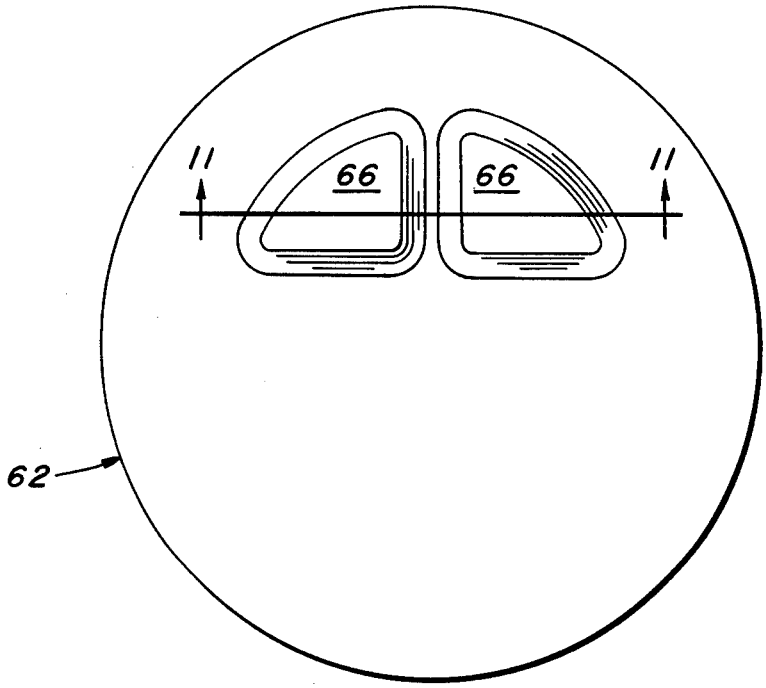
FIG. 10 is a plan view of a coining surface adapted to cooperate with the coining punch of FIGS. 7, 8 and 9 to form the vent release device of FIGS. 1 and 2.
Figure 11:
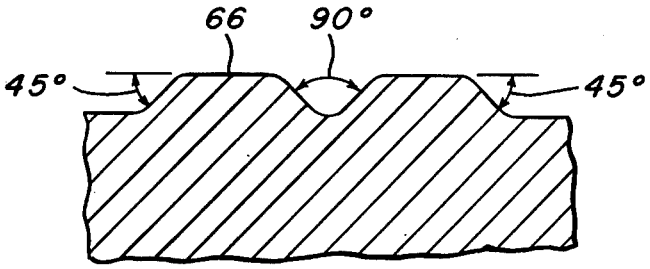
FIG. 11 is a cross-sectional view through the coining surface of FIG. 10.

FIGS. 7 through 11 illustrate dies for forming embossments in a container wall to produce a pressure release device of this invention. FIGS. 7, 8 and 9 illustrate a first die 60 with a die outside punch 64 and die center punch 68 thereon, and FIGS. 10 and 11 illustrate a second die 62 with a die surface 66 for cooperating with the die punches to form two embossments in a container wall. The die outside punch 64 has a general outline of two right triangles with adjacent sides parallel. Between these parallel sides is the die center punch 68. The die surface 66 is adapted to fit within the triangular outlines of the die outside punch. The metal shaping faces of the die punches and die surface are parallel and are preferably disposed at approximately a 45° angle to the direction of die travel to form embossments in a container wall with side walls at a similar angle. The corners on the die punches and die surfaces are given suitable radii for forming thin sheet metal, such as approximately 0.050 inch, as shown in FIG. 13.

Figure 12:
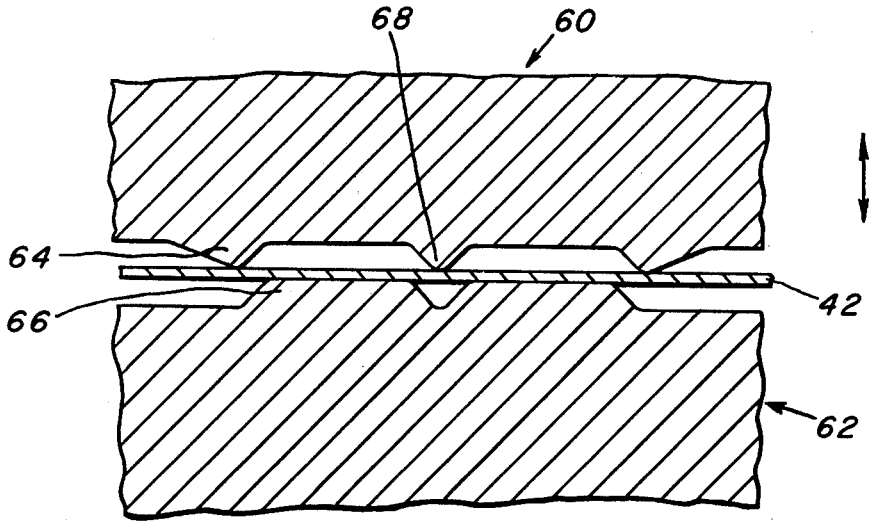
FIG. 12 is a cross section through the coining punch and die of FIGS. 7–11 preparatory to forming a container wall of this invention.

FIG. 12 shows that the first die 60, with die outside punch 64 and die center punch 68, and a second die 62, with die surface 66, with a container wall 42 therebetween preparatory to forming two triangular embossments and a rib therebetween. The container wall 42 has a score line previously formed therein so as to cross the rib which is to be formed in the wall.

Figure 13:
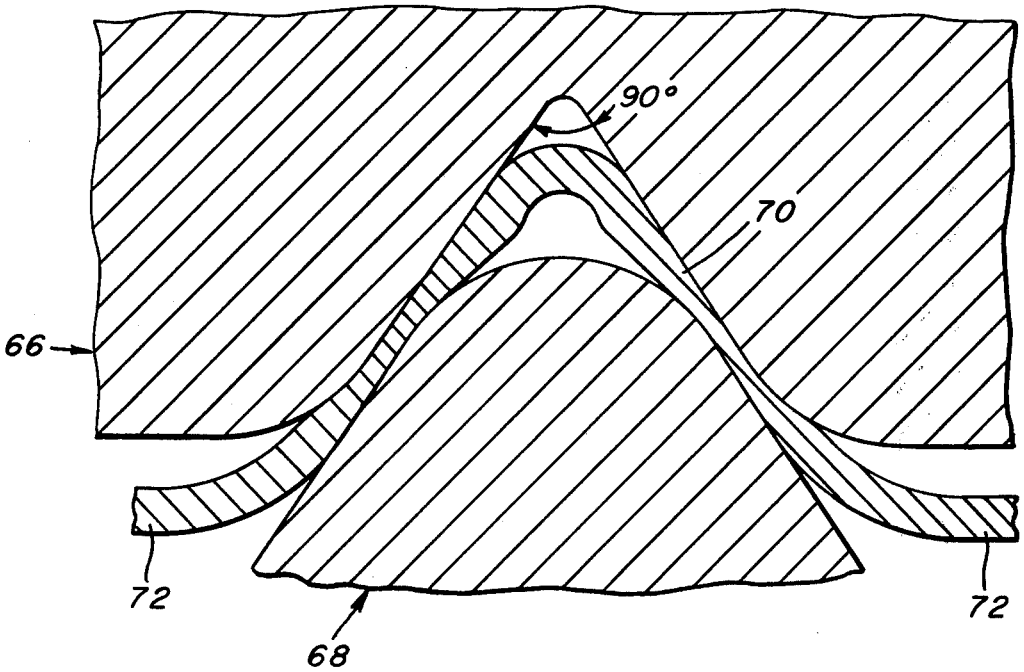
FIG. 13 is a fragmentary cross-sectional view through the center rib and coining surface of FIGS. 7–12 showing an embossed hollow rib of this invention formed between such tools.

FIG. 13 illustrates the cooperation of the die center punch 68 and die surface 66 to form a hollow rib 70 between embossment portions 72. As illustrated in that figure, the die center punch squeezes the metal in a container wall against the die surface to extrude metal therebetween to form a relatively high rib. Such extrusion of metal also thins the metal in the side wall of each embossment.

It is seen that a pressure release device and a method of forming the same in a container wall have been illustrated and described. The pressure release device is adapted to be digitally actuated and is not substantially effected by changes in the internal pressure in a container. Although a preferred embodiment has been illustrated and described, it will be appreciated by those skilled in the art that numerous variations can be made in the container wall and the method of forming the same without departing from the invention or the scope of the claims attached hereto.

What is claimed is:

1. In a container having a vent release means comprising a container wall having an inwardly projecting hollow rib and a weakening line across the rib, an improveent comprising walls transverse to the longitudinal axis of said rib and to the general plane of said container adjacent to both ends of said rib, which improvement minimizes effects of changes in internal pressure of said container on the force required to rupture said weakening line.

2. A frangible rib vent opening means for a container comprising a container wall, two adjacent outwardly projecting hollow embossments in the container wall separated by and forming part of an inwardly projecting hollow rib with a score line across the rib near the middle of the rib, each of said embossments having a top wall and a side wall therearound connecting the top wall to the adjacent portion of the container wall, said side wall at both ends of said rib being generally transverse to the longitudinal axis of the rib.

3. A vent opening means as set forth in claim 2 in which the apex of said rib is generally coplanar with the general plane of the container wall adjacent to said embossments.

4. A vent opening means as set forth in claim 2 in which the side wall of each embossment has an extent of at least approximately 10 percent of the length of said rib perpendicular to the general plane of the container wall.

5. A vent opening means as set forth in claim 2 in which the side wall of each embossment has an extent of at least five times the material thickness of said container wall perpendicular to the general plane of the container wall.

6. A vent opening means as set forth in claim 2 in which the side wall of each embossment has an extent of approximately seven times the material thickness of said container wall perpendicular to the general plane of the container wall.

7. A vent opening means as set forth in claim 2 in which said score line has a residual material thickness of less than half the thickness of the container wall.

8. A vent opening means as set forth in claim 2 in which said container wall is made of hard temper aluminum.

9. A vent opening means as set forth in claim 2 in which the side wall of each said embossment is thinner than the adjacent container wall.

10. A vent opening means as set forth in claim 9 in which the apex of said rib is generally coplanar with the general plane of the container wall adjacent to said embossments, and in which the side wall of each embossment has an extent of at least five times the material thickness of said container wall perpendicular to the general plane of the container wall, and in which the residual metal thickness of the score line is less than half the thickness of the container wall.

11. In a container having an inwardly displaceable opening panel defined by a fracturable web, an improvement comprising a frangible vent opening means including a container wall portion, two adjacent outwardly projecting hollow embossments in the container wall portion separated by and forming part of an inwardly projecting hollow rib with a score line across the rib near the middle of the rib, each of said embossments having a top wall and a side wall therearound connecting the top wall to the adjacent portion of the container wall portion, said side wall at both ends of said rib being generally transverse to the longitudinal axis of the rib.

* * * * *